US005647284A

United States Patent [19]

Frysinger et al.

[11] Patent Number: 5,647,284

[45] Date of Patent: Jul. 15, 1997

[54] METHOD AND APPARATUS FOR SHIPPING KNOBBED GLASS COOKWARE COVERS

[75] Inventors: Eric T. Frysinger, Groveport; Joe Pirello, Reynoldsburg, both of Ohio

[73] Assignee: Newell Operating Company, Freeport, Ill.

[21] Appl. No.: 438,223

[22] Filed: May 9, 1995

[51] Int. Cl.[6] ..... B65D 19/44

[52] U.S. Cl. ..... 108/55.1; 108/55.3; 108/53.1

[58] Field of Search ..... 108/55.1, 55.3, 108/53.1, 53.3, 53.5, 91, 92; 206/386, 595, 599, 600

[56] References Cited

U.S. PATENT DOCUMENTS

| | | | |
|---|---|---|---|
| 3,151,578 | 10/1964 | Jones | 108/46 |
| 3,565,018 | 2/1971 | Jay | 108/53.1 |
| 3,857,494 | 12/1974 | Giardini | 108/55.1 X |
| 4,043,462 | 8/1977 | Schiron | 108/55.1 |
| 4,653,651 | 3/1987 | Flum | 108/55.3 X |
| 4,703,702 | 11/1987 | Speicher | 108/53.1 X |
| 4,735,321 | 4/1988 | Day | 108/55.1 X |
| 5,025,735 | 6/1991 | Chan et al. | 108/55.1 |
| 5,097,951 | 3/1992 | Pigott et al. | 108/55.3 X |
| 5,169,011 | 12/1992 | Ebeling et al. | 108/53.1 X |
| 5,360,112 | 11/1994 | Beauchamp | 108/55.3 X |

FOREIGN PATENT DOCUMENTS

| | | | |
|---|---|---|---|
| 1482078 | 5/1967 | France | 108/53.1 |
| 2224993 | 5/1990 | United Kingdom | 108/55.3 |

*Primary Examiner*—Jose V. Chen

*Attorney, Agent, or Firm*—Foley & Lardner

[57] ABSTRACT

A shipping pallet, a shipping container, and a system for, and method of, spacing and shipping knobbed glass cookware covers which includes a collapsible pallet, multiple cover partitions and a top plate. The pallet has a horizontal, fork lift compatible frame and four vertical corner posts which may be removed for purposes of storing/stacking empty pallets. Fully-loaded pallets with corner posts inserted may also be stacked one above the other. The partitions are formed from corrugated cardboard into a shape similar to that of the pallet and include corner notches to engage the pallet's vertical posts. The pallets also have an array of circular indentations formed into their top surfaces and a small hole formed in the middle of each indentation. One glass cover's knob may project through the small hole from the partition's underside while a second cover's lower rim may sit within an indentation on the partition's top side. Covers from different layers are aligned in a vertical fashion upon the pallet. The foregoing assembly is secured by placing a rigid top plate, having holes to receive glass cover knobs, over the uppermost layer of covers and tying the partitions, covers and top plate to the pallet with wrapping straps to form a shipping container.

13 Claims, 6 Drawing Sheets

Fig. 1.
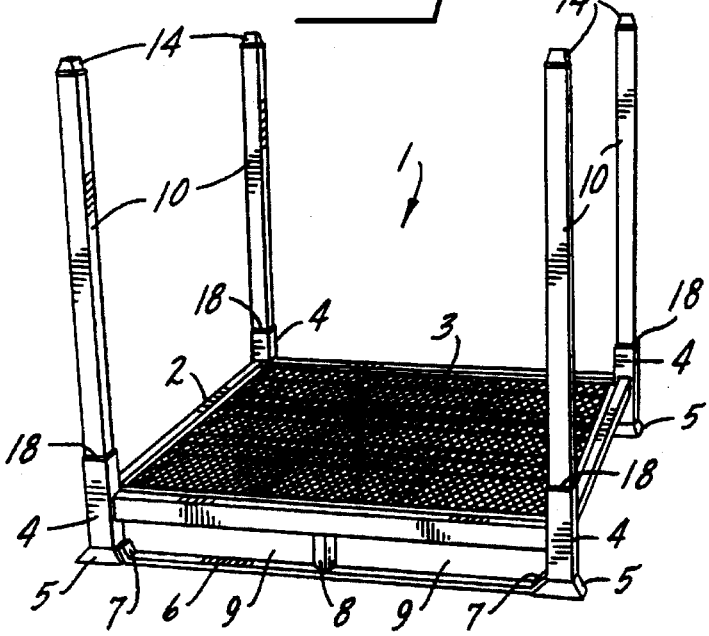
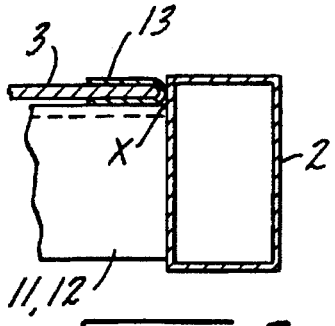
Fig. 3.
Fig. 2.
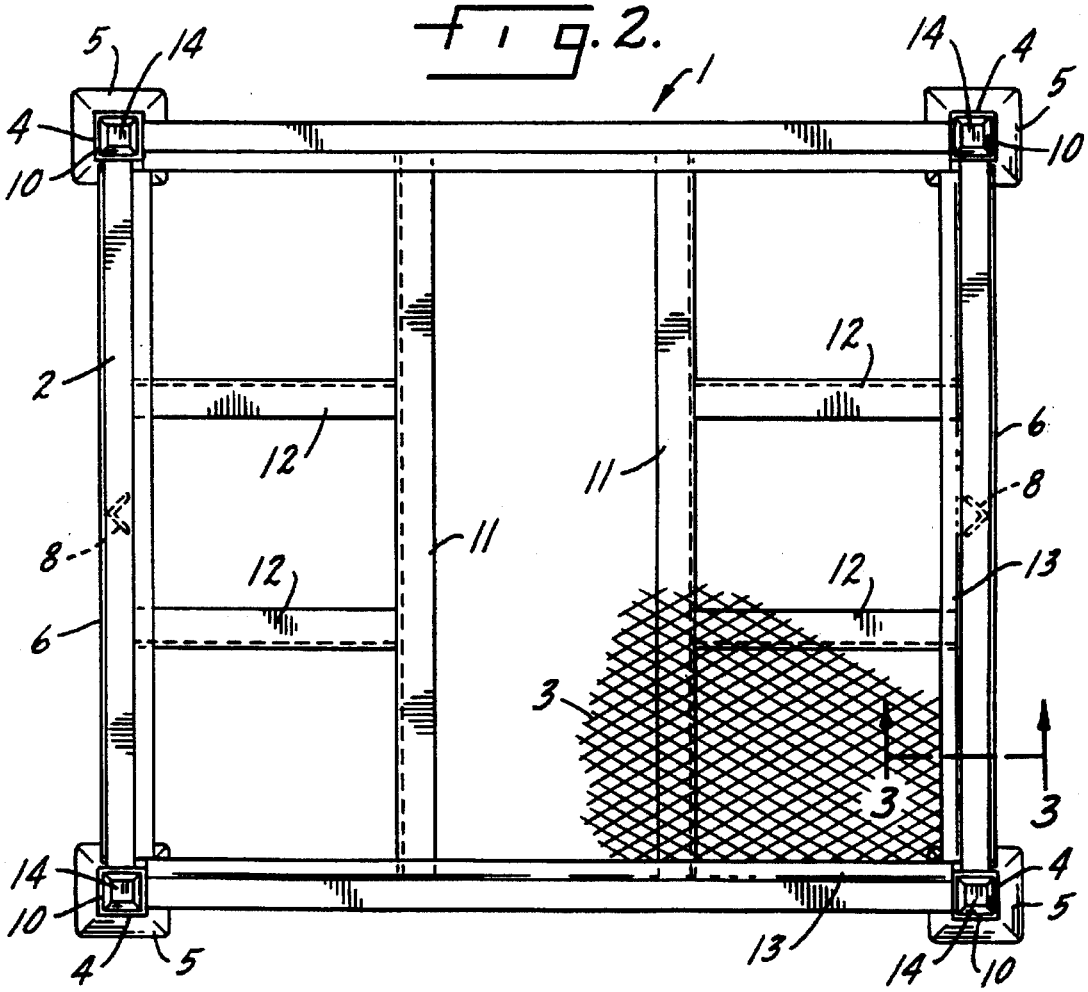

METHOD AND APPARATUS FOR SHIPPING KNOBBED GLASS COOKWARE COVERS

FIELD OF THE INVENTION

The present invention relates generally to shipping containers and, more specifically, to a shipping container having both a pallet with four detachable corner posts and specially designed partitions to separate layers of fragile and/or awkwardly shaped goods stacked on the pallet.

BACKGROUND OF THE INVENTION

The prior art contains numerous references in the fields of shipping containers and assemblies for stacking cookware including U.S. Pat. No. 5,251,753 to Pigott, U.S. Pat. No. 5,246,113 to Schuster, U.S. Pat. Nos. 4,993,553 and 4,936,457 to Kicherer, et al., U.S. Pat. No. 4,098,400 to Brown and U.S. Pat. No. 5,111,950 to Wylenzek.

The Pigott patent, U.S. Pat. No. 5,251,753, discloses a unit for shipping and displaying a number of vertically stacked products separated by horizontal dividing trays. These trays further support upright dividers which also maintain separation between the product containers. For enhanced stability, each tray is provided with an individual corner support member which extends between an adjacent pair of vertically separated trays. All such trays are stacked upon an industry-standard pallet and secured therein by four corner posts.

The Schuster patent, U.S. Pat. No. 5,246,113, discloses a uniquely designed container carrier having overlapping top panel flaps to reinforce the handle support area and a separating sheet which is displaced between layers of stacked containers which prevents direct contact between them. The top panel flaps include multiple score lines which serve to relieve stress on the carrier as it is lifted and transported.

The Kicherer patents, U.S. Pat. Nos. 4,993,553 and 4,936,457, disclose stacking arrangements for electric hot plates which simply employ a pallet and multiple pallet plates. All such pallet plates have an array of receptacles, or shelves, in which the electric hot plates may be received. The underside of these receptacles are so shaped so as to fit neatly within the top side of an electric hot plate located immediately underneath.

The Brown patent, U.S. Pat. No. 4,098,400, discloses a packaging system which includes a conventional pallet structure and a plurality of horizontal trays. These trays are substantially planar and have receptacles which are formed on opposite sides of the trays. Parts are intended to be layered between the plurality of these trays and the receptacles are designed so that the top and bottom of vertically adjacent parts are separated from one another, yet interlocked by the trays.

The Wylenzek patent, U.S. Pat. No. 5,111,950, discloses a particular shipping container having a metal pallet base and four square metal corner posts extending vertically upward from the pallet base. An inverted box-shaped cover having vertical square recesses in each of its corners is then slidably received on the pallet corner posts to effect a four sided and covered shipping container. Means are also provided to lock the cover to the pallet base once the container is closed.

From the foregoing, it should be recognized that there is still a need for a shipping container, having particular application to fragile and/or awkwardly-shaped cookware pieces, which comprises the fewest number of packaging components, securely maintains each piece in spaced-apart relation to the others, facilitates both the rapid packaging and the rapid unpackaging of the pieces being shipped, and can be disassembled and stored in a minimal amount of space.

SUMMARY OF THE INVENTION

The present invention is distinguishable over the prior art in general, and the above-noted patents in particular, by providing a method and apparatus for shipping knobbed glass covers which employs a collapsible pallet, inexpensive and uniquely designed partitions and a rigid top plate. Together, these components may be used to stack layers of knobbed glass covers in a quick, secure and cost effective manner.

The present invention first provides a lightweight, yet very rigid pallet having detachable vertical corner posts. For storage or shipping purposes, these posts may be removed from the pallet and laid flat upon the pallet's face so as to minimize the amount of space it occupies. In addition, these pallets have the capability of being stacked one upon the other either with or without their vertical corner posts in place.

A further distinguishing feature of the present invention is the application of a uniquely designed partition to separate layers of knobbed glass covers. Each partition, preferably formed of corrugated cardboard, has a substantially square size and shape approximately equal to the bottom surface of an associated pallet and includes inwardly formed notches at its corners to complimentarily engage the four corner posts of the pallet as the partition is set in place.

Each partition also includes an array of equally-spaced, circular indentations on the partition's top side which are designed to accommodate and accurately position the lower rim of a glass cover placed thereupon. Within each indentation, substantially formed from a small circular cut in the center and two radial cuts extending outward therefrom, is a small flap with a circular tip which is forcibly raised upward as a glass cover knob from the layer of covers underneath projects through the partition's underside. The circular tip of this flap remains in contact with the top side of the knob to prevent the knob from touching the glass cover placed immediately above it on the top side of the partition. Additional radial cuts extending from the indentation to the opening formed by the circular tip are also provided to allow the portion of the partition within the indentation to conform to the upper surface of the glass cover located directly underneath. A number of "cover-partition-cover-partition . . . " layers may then be constructed upon a single pallet.

The present invention further provides for a rigid top plate which has a size and shape substantially equal to a partition and which has small round holes which coincide with the placement of the knobs of the top-most layer of glass covers on the pallet. Once the top plate is in place, a number of wrapping straps may be used to encircle and secure the entire assembly whereby the top plate, partitions and glass covers are "tied" to the pallet.

A significant technological advantage is gained by the user of the present invention in that it provides a link for total process automation. Current methods for stacking glass covers require manipulations which can only be performed by people. Conversely, the proposed invention requires no complicated manipulations thus rendering it more adaptable to a fully-automated process. The preferred embodiment provides a means for positive positioning of the glass covers which may be required for automatic packing and unpacking. Further, because of the relatively uniform shape of a fully-assembled structure, the present invention is easily adapted into a fully-automated warehousing system.

It is therefore a general object of the present invention to provide a novel means of shipping knobbed glass cookware covers, or similarly shaped fragile goods, which does not require the individual packaging of each item.

In addition, it is an object of the present invention to provide a means for shipping large quantities of knobbed glass cookware covers whereby the covers are securely maintained in spaced-apart relation to each other.

Another object of the present invention is to minimize the weight and expense associated with packaging and shipping knobbed glass cookware covers.

It is a further object of the present invention to provide an overall system for, and method of, stacking and shipping knobbed glass cookware covers in a uniquely time-saving manner.

In another one of its aspects, it is an object of the present invention to provide a collapsible pallet which can be stored and shipped in a minimal amount of space.

Further objects and advantages of the invention will become apparent to those of ordinary skill in the pertinent art upon review of the following detailed description, accompanying drawing and appended claims.

BRIEF DESCRIPTION OF THE DRAWING

This invention is illustrated more or less diagrammatically in the accompanying drawing, wherein:

FIG. 1 is a perspective view of the pallet of the present invention with vertical posts inserted;

FIG. 2 is a top view of the pallet and vertical posts of FIG. 1;

FIG. 3 is a cross-sectional view of the pallet frame taken substantially along line 3—3 of FIG. 2;

Figure 4:
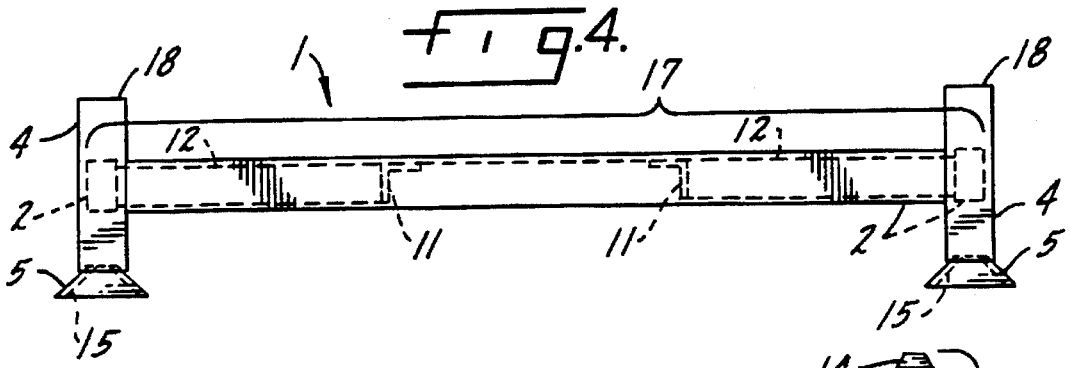
FIG. 4 is a side view of the pallet of the present invention.

Notice must be taken that the Figures are not necessarily to scale and that the embodiments are sometimes illustrated by graphic symbols, phantom lines, and diagrammatic representations. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF THE DRAWING

Shown generally in FIG. 1 is a pallet 1 of the present invention. This preferred embodiment includes a frame 2, a pallet top 3, four corner legs vertical posts are indicated at 10.

Each of the legs 4 of the pallet 1 include a broad base 5 which, in turn, has a two-fold purpose. First, the broad dimensions of each base 5 provide a great deal of stability not only to the legs 4 but also to the overall pallet 1. In addition, the underside of each base 5 is specifically designed to receive, for stacking purposes, either the bevelled upper ends 14 of vertical posts 10 or, if vertical posts 10 are removed, the upper edges 18 of the legs 4. Additional details regarding the present invention's stacking capabilities may be found in the discussion of FIGS. 5 and 10.

Further rigidity of the pallet i is provided by means of a cross bar 6 having inclined edges 7 which are securely affixed between adjacent bases 5 on the pallet 1. The underside of this cross bar 6 is in the same horizontal plane as the underside of the adjoining bases 5 so as to completely engage the surface upon which this pallet 1 is placed. Additional support is provided via a vertical brace 8 which is formed of a short piece of 90-degree angle iron and which is securely interconnected between the frame 2 and the cross bar 6 at an approximate mid-point along one side of the pallet 1. This preferred design offers a relatively light, yet extremely strong, stacking and shipping structure which may receive the tines of a fork-lift through lift openings 9.

The top view of the pallet 1 which is shown in FIG. 2 offers a view of the additional frame supports 11 and 12 which are secured within the frame 2. The full-length frame supports 11 and one-third length frame supports 12 are designed to both reduce any torquing effect which is placed upon the pallet 1 and provide a horizontal surface upon which the pallet top 3 and its lipped edge 13 may lay. Frame supports 11 and 12 are also formed of 90-degree angle iron whereby one side of the angle iron provides the above-noted horizontal surface.

This top view of the pallet 1 exemplifies the substantially larger dimensions of the bases 5 with respect to both the legs 4 and vertical posts 10. The combination of the frame 2, the broad bases 5, the vertical braces 8 and the frame supports 11 and 12 provide a uniquely rigid structure which significantly reduces the effects of torquing and off-balance weighting both when the pallet 1 is on the ground and when the pallet 1 is being lifted and transported by a fork-lift.

Turning now to FIG. 3, a cross-sectional view of the frame 2 is provided in order to demonstrate the preferred means of "nesting" the pallet top 3 within the pallet 1. The pallet top 3 is preferably constructed of a steel mesh whereby its unprotected edges are crimped with a solid metal lipped edge 13. It is intended that the upper surface of this lipped edge 13 be parallel with the upper surface of the frame 2. Accordingly, the frame supports 11 and 12, upon which the pallet top 3 and lipped edge 13 lay, are attached to the frame 2 at a point X whereby such preferred placement of the pallet top 3 may be accomplished.

FIG. 4 offers a side view of the pallet 1 of the present invention whereby the structural connection between the frame 2 and the legs 4 may be observed. Also shown is an end view of the full-length frame supports 11 and the relative placement of the pallet top 3 thereupon.

Figure 5:
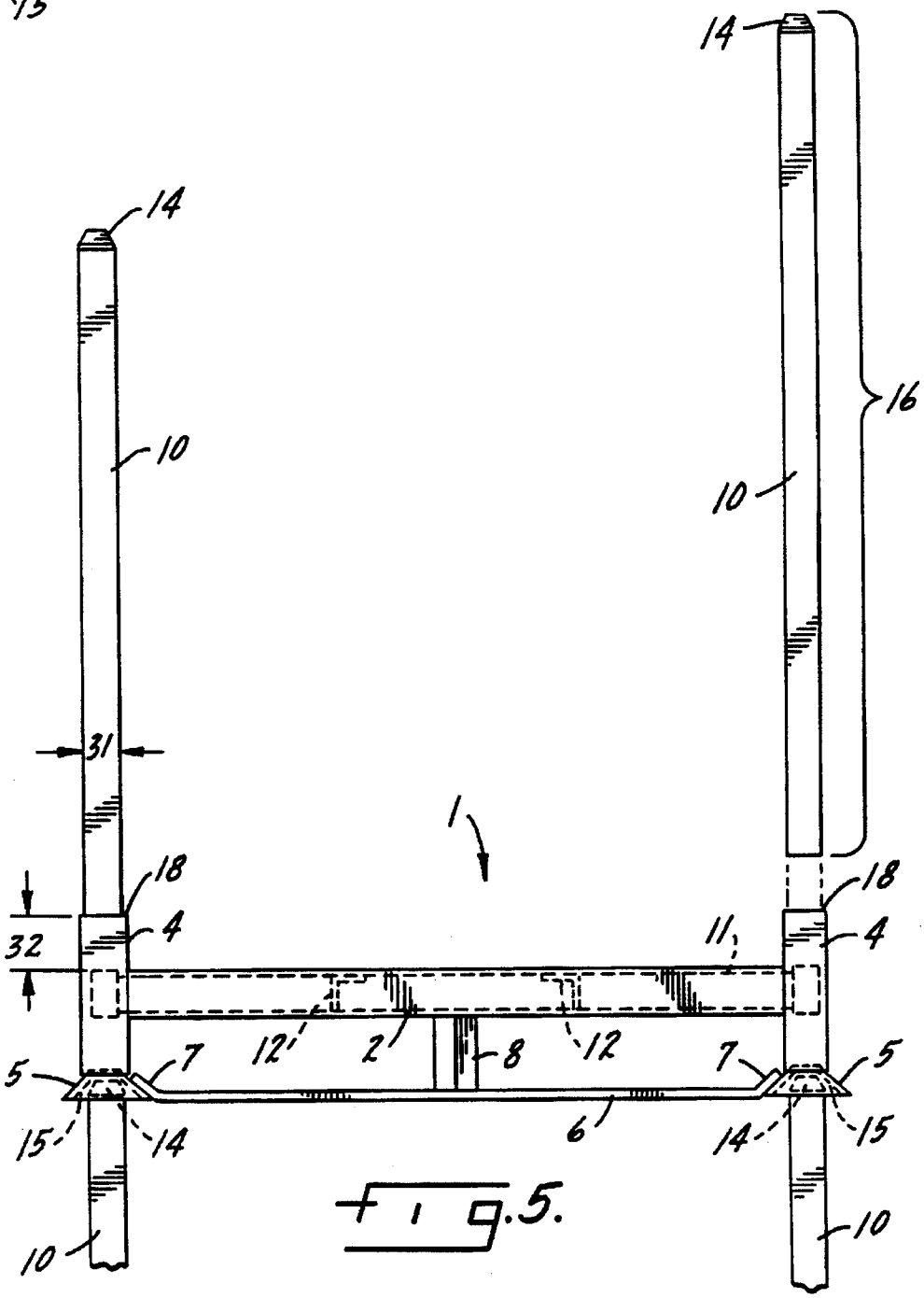
FIG. 5 is a second side view of the pallet with vertical posts inserted and being stacked upon a second set of vertical posts.

FIG. 5 demonstrates the novel detachability and stackability of the pallet 1 of the present invention. When the pallet 1 is not being used or must be transported in as compact a fashion as possible, the vertical posts 10 may be removed from their associated legs 4 and simply laid upon the pallet top 3. The height 16 of each vertical post 10 is substantially equal to the frame width 17 (see FIG. 4) of the frame 2 to ensure that the ends of the vertical posts 10 do not extend beyond the outermost dimensions of the pallet 1 defined by the outer edges of the legs 4. In addition, the vertical posts 10 have a width 31 which is slightly less than the distance 32 between the pallet top 3 and the upper edge 18 of each leg 4. Accordingly, even with vertical posts 10 placed upon the pallet tops 3, multiple pallets 1 may be stacked one upon the other with the conical underside 15 of each base 5 accepting the upper edge 18 of a leg 4 from a pallet 1 positioned immediately underneath.

Alternatively, if it is desirable to keep the vertical posts 10 inserted within the legs 4, either because the pallet 1 is stacked with goods or for other various reasons, the pallets 1 may be stacked as shown in FIG. 5 whereby the conical underside 15 of each base 5 may be securely placed over a beveled upper end 14 of a vertical post 10. This quick and simple detachable design affords the user of these pallets 1 a great deal of flexibility in determining how to store, stack and ship these pallets 1 for any one particular application.

Figure 6:
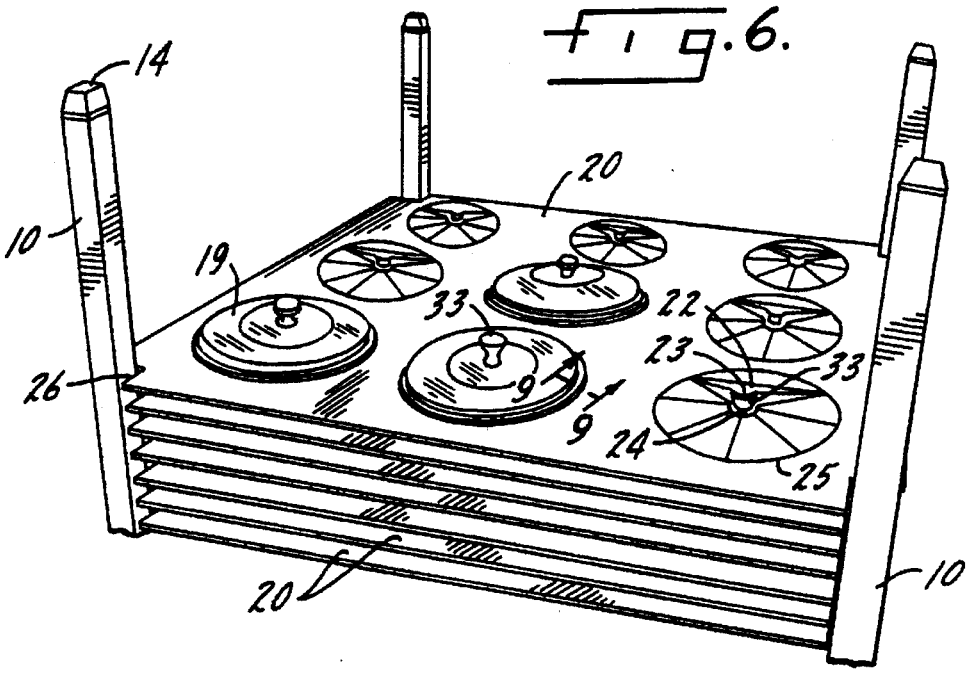
FIG. 6 is a perspective view of the partitions, knobbed glass cookware covers and vertical posts of the present invention stacked upon a pallet.

FIG. 6 presents the combination of the above-described pallet 1 being used in conjunction with a plurality-of partitions 20 and knobbed glass cookware covers 19. Each partition, preferably constructed of corrugated cardboard, includes a number of equally-spaced circular indentations 25 formed on its top side. Each indentation 25 corresponds to the substantially circular size and shape of the lower rim 38, see FIG. 9 of each glass cover 19. The circular indentations 25 serve as guides by which an individual may accurately place a layer of glass covers 19 upon a partition 20 while also serving to inhibit, to some degree, horizontal movement of the glass covers 19. The horizontal movement of the partition 20 itself is also inhibited via the inwardly formed notches 26 at each of its four corners which complementarily engage the vertical posts 10.

In addition, as a single partition 20 is placed over one layer of glass covers 19, each knob 33 of a glass cover 19 extends through an opening 24 formed by a cut-out of circular tab 23. More precisely, the knob 33 is positioned within the opening 24 which is the area formed by the detached circular tab 23. Such tab 23 remains in contacting engagement with the top surface of this knob 33 as it is an extension of flap 22. This positioning of the knob 33 within the opening 24 significantly inhibits the horizontal movement of the knob 33 and, in turn, the overall horizontal movement of each glass cover 19.

Figure 7:
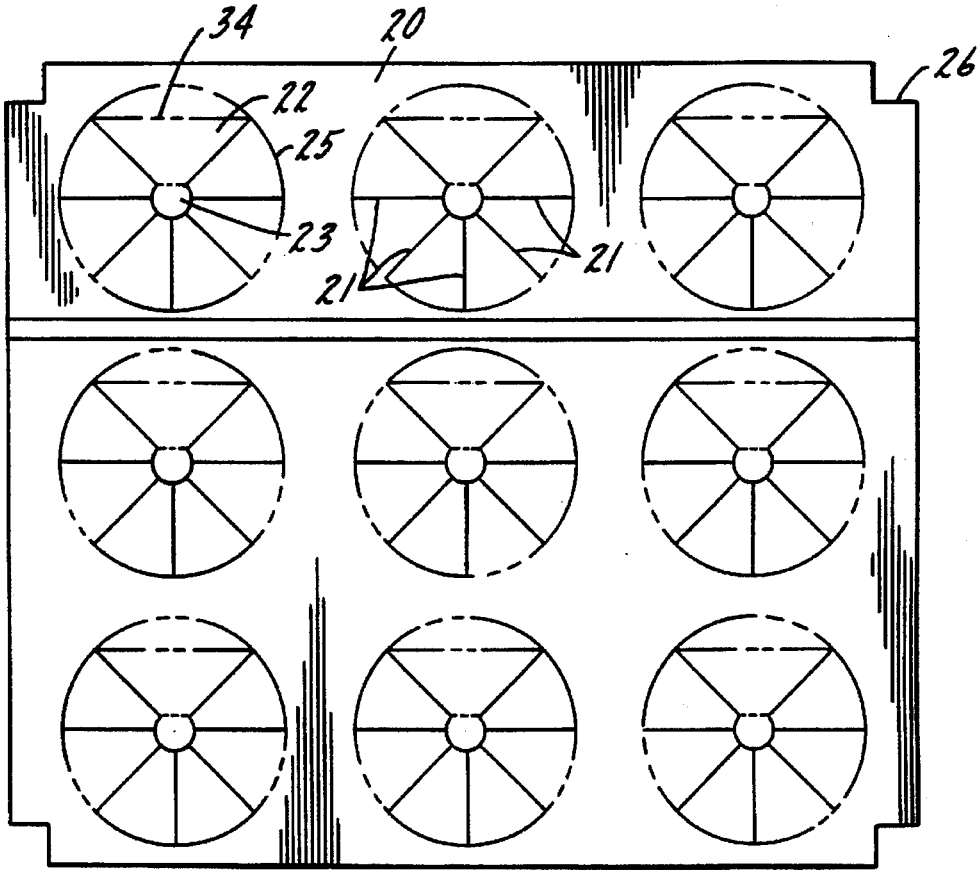
FIG. 7 is a top view of a single partition.

FIG. 7 is a top view of a single partition 20 of the present invention's preferred embodiment. This substantially flat partition 20 may be simply stamped from a sheet of corrugated cardboard and does not require any further construction before its intended use. The partition 20 includes a plurality of circular indentations 25 arranged in parallel rows and columns. Within each circular indentation 25 is a wedge-shaped flap 22 and attached tab 23. Each flap 22 is angled upwards from horizontal along a fold line 34 when accomodating a knob 33 from an underlying glass cover 19. At the same time, radial cuts 21 allow the adjacent wedge-shaped portions of the partition 20 which are within the circular indentation 25 to "conform" to the upper surface of a glass cover 19 positioned underneath. Partition 20 need not be bound on all four of its sides to be retained upon a pallet 1 as its four corners include small notches 26 which are dimensioned so as to be snugly interconnected with an associated vertical post 10.

Figure 8:
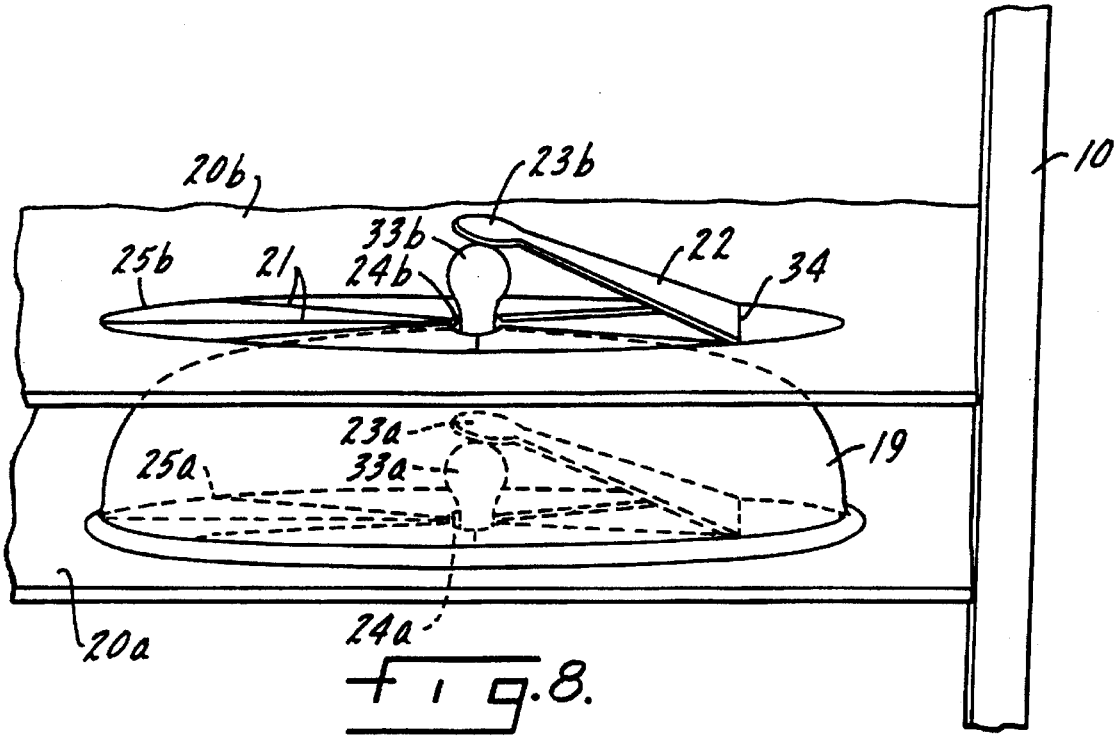
FIG. 8 is a side view to an enlarged scale of two vertically adjacent knobbed glass cookware covers and associated partitions.

Referring now to FIG. 8, a partial view of a stacked cover assembly is shown wherein a lower partition 20*a* is first placed over knob 33*a* on a lower glass cover (not shown) via opening 24*a*. A second glass cover 19 is then placed upon the top of partition 20*a* with its lower rim 38 nesting within circular indentation 25*a*; see also FIG. 9. The presence of circular tab 23*a* prevents any inadvertant contact between knob 33*a* and the underside of glass cover 19. Another partition 20*b* may then be placed over knob 33*b* on glass cover 19; knob 33*b* simultaneously being received through opening 24*b* while it pushes tab 23*b* and wedge-shaped flap 22 upwards. Flap 22 is designed to offer such angular flexibility through the existance of crease line 34. Radial cuts 21, running between circular indentation 25*b* and opening 24*b*, allow the adjacent wedge-shaped portions of the partition 20*b* which are within the circular indentation 25*b* to conform to the upper surface of glass cover 19. Additional layers of glass covers and partitions may subsequently be added to the assembly shown in FIG. 8 if so desired.

Figure 9:
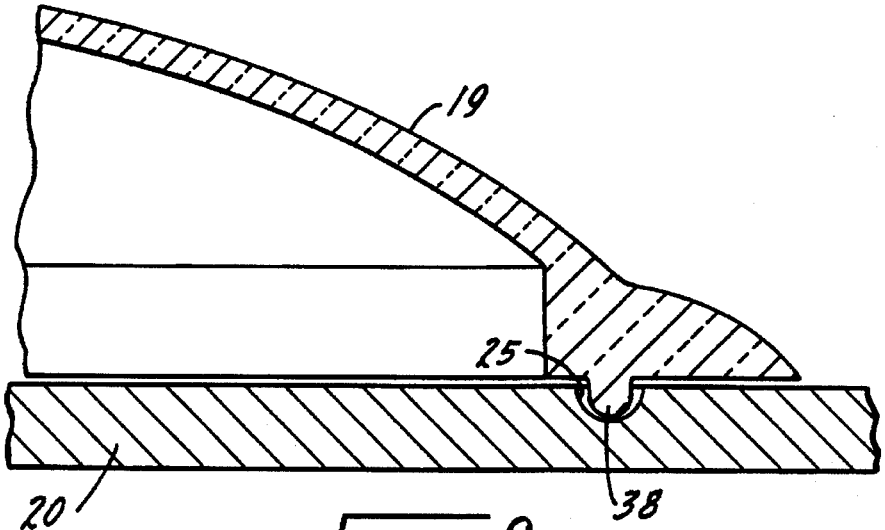
FIG. 9 is a cross-sectional view of a cover's lower edge in its corresponding circular indentation on a partition taken along line 9—9 of FIG. 6.

FIG. 9 presents a cross-sectional view of the circular indentation 25 on the partition 20 of the preferred embodiment. The lower rim 38 of a glass cover 19 is received and substantially retained within circular indentation 25 ensuring the proper positioning of the glass cover 19 upon the partition 20 and inhibiting the cover's horizontal movement during the stacking, wrapping and shipping processes.

Figure 10:
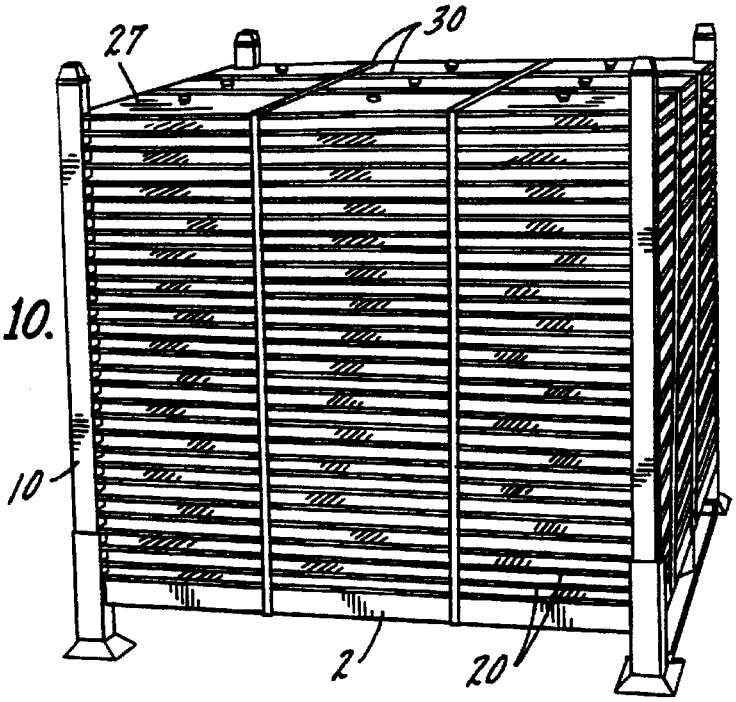
FIG. 10 is a perspective view of a shipping-ready assembly including a pallet, vertical posts, partitions, knobbed glass cookware covers, top plate and wrapping straps.

Turning now to FIG. 10, a fully stacked, wrapped and ready-to-ship pallet assembly is displayed. In addition to those components already discussed, this embodiment further includes a rigid top plate 27 and wrapping straps 30. When the height of the stacked glass covers 19 and partitions 20 approaches the top of the vertical posts 10, the rigid top plate 27 is placed over the uppermost layer of glass covers 19 whereby wrapping straps 30 may then be used to secure the glass covers, partitions and top plate 27 to the frame 2.

This preferred embodiment obviates the need for either a complete box-like enclosure or individual and bulky packaging of each knobbed glass cover 19. The preferred embodiment shown in FIG. 10 exemplifies the compact yet extremely rigid means of protecting these fragile goods as they are then shipped to a final destination.

Figure 11:
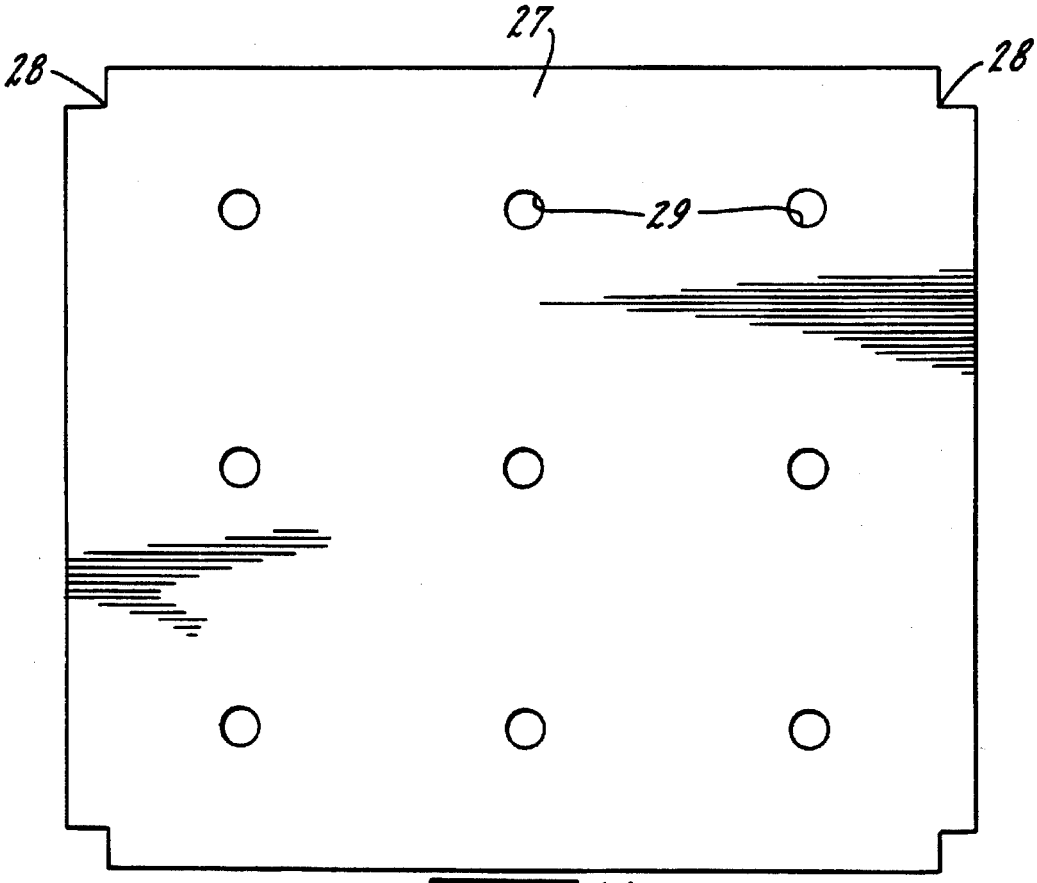
FIG. 11 is a top view of the top plate of the present invention.

FIG. 11 is an enlarged view of the rigid top plate 27 of the present invention. The outer dimensions of rigid top plate 27, including inwardly formed notches 28, are substantially identical to those of the partitions 20. Plate 27 further includes round holes 29 which are sized to securely accommodate the knobs 33 from the uppermost layer of glass covers 19 on the pallet 1. These holes 29 are in substantial vertical alignment with the circular tabs 23 on the partitions 20 as shown in FIG. 7. Rigid top plate 27 is composed of a predominantly non-bendable material such that the downward forces exerted on the overall assembly by the tightening of the wrapping straps 30 are applied evenly to each layer of goods and not primarily to the outer edges of the partitions 20.

Figures 12A, 12B, 12C, 12D, 12E, 12F, 12G, 12H, 12I:
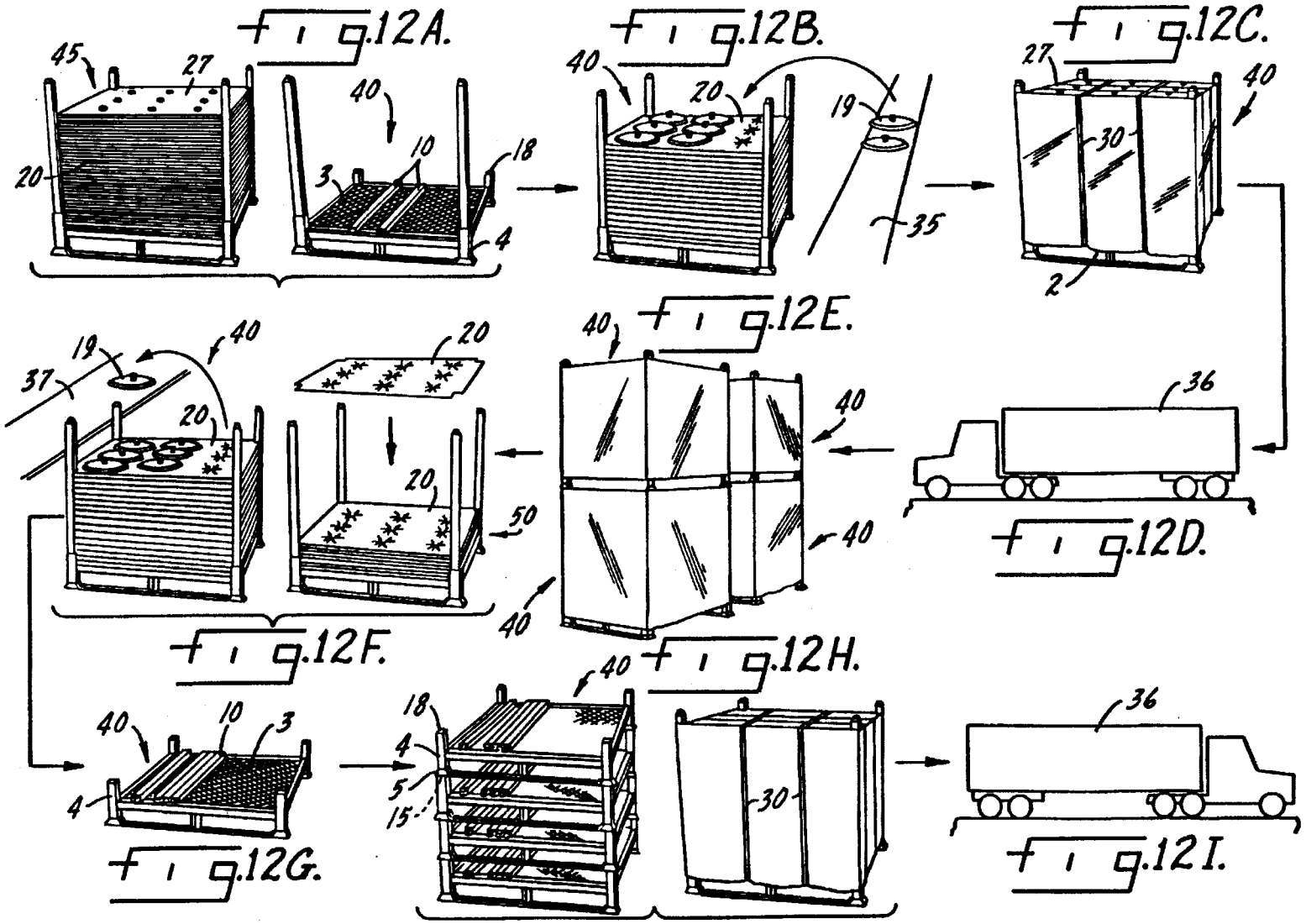
FIG. 12 shows the steps involved in the complete method and system for stacking and shipping knobbed glass cookware covers according to the present invention.

The benefits associated with the uniquely designed pallet, partitions and top plate of the present invention may be more fully appreciated by examining the overall method for stacking and shipping knobbed glass covers as indicated in FIG. 12. Step A shows a typical "stacking station" at a glass cover packaging facility. A first pallet 40, which has likely been stored in a compact manner whereby its vertical posts 10 were laid upon its pallet top 3, may be quickly assembled by inserting the vertical posts 10 into the upper edges 18 of the pallet legs 4. A second pallet 45 maintaining a full stack of partitions 20 should be placed along side the first pallet 40.

Referring now to Step B, first pallet 40 may be stacked alternatively with partitions 20 taken from second pallet 45 and with knobbed glass covers 19 which are delivered to the stacking station via a conveyor belt 35 or other means.

As first pallet 40 is stacked with its maximum limit of partitions 20 and knobbed glass covers 19, a rigid top plate 27 may be placed over the uppermost layer of knobbed glass covers 19 and a plurality of wrapping straps 30 used to secure the entire assembly to the pallet frame 2 as indicated at Step C.

Pallets which have been fully stacked and secured may then be loaded onto a truck 36, or other means of transportation, as shown in Step D.

Step E shows how pallets which have been unloaded from a truck may be conveniently stacked one upon the other until such time when the enclosed glass covers need to be unpackaged.

Step F shows a typical "unpacking station" which would include the fully stacked first pallet 40 and a second pallet 50 which is initially empty. Glass covers 19 are removed from first pallet 40 and placed on a conveyor belt 37 or other means for delivering these covers to their destination. At the same time, the empty partitions 20 which are removed from first pallet 40 may be stacked upon empty pallet 50 for ultimate shipment back to the packaging plant. Clearly, by obviating the need to package and unpackage the knobbed glass covers 19 individually, the present method of stacking and shipping is not nearly as labor intensive as those packaging designs which are currently employed in this field.

As first pallet 40 is emptied, as indicated in Step G, its vertical posts 10 may be removed from its legs 4 and subsequently laid flat upon the pallet top 3.

As shown in Step H, first pallet 40 may then be stacked upon other pallets having their vertical posts removed by placing the conical underside 15 of each base 5 over a vertically aligned upper edge 18 on a leg 4 of an adjacent pallet positioned immediately underneath. The complete upright assembly comprised of the compactly stacked pallets may then be secured via wrapping straps 30 in preparation for shipment back to the packaging facility.

Lastly, Step I represents the loading and shipping of all empty pallets and partitions back to the packaging facility whereby the stacking and shipping process will begin anew at Step A.

While the present invention has been illustrated in some detail according to the preferred embodiment shown in the foregoing drawing and description, it will be apparent to those skilled in the pertinent art that variations and equivalents may be made within the spirit and scope of that which has been expressly disclosed. Accordingly, it is intended that the scope of the invention be limited solely by the scope of the hereafter appended claims and not by any specific wording in the foregoing description.

We claim:

1. An apparatus for stacking knobbed glass cookware covers, the apparatus comprising:

(a) a pallet, said pallet including a frame structure having a plurality of corners, said pallet receiving a pallet top, said pallet also including vertical frame supports, each vertical frame support being securely attached to one of said corners of said frame structure, said pallet further including detachable vertical posts, each post being vertically insertable into an upper end of an associated frame support and vertically removable from said upper end; and (b) a plurality of partitions for separating layers of goods stacked upon said pallet wherein each of said goods is generally flat yet has an upright projection, the partition having a size and shape approximately equal to that of said pallet and whereupon a layer of goods may be placed, the partition further including a plurality of integrally-formed flaps, each flap assuming an upwardly-angled position as one of said projections from a layer of goods stacked immediately underneath the partition projects upward through an opening in the partition formed by said flap, wherein said detachable vertical posts have a height which is approximately equal to a horizontal width of said frame structure and may be laid upon said pallet top for storage purposes, wherein said frame supports extend a vertical distance upward above the plane in which said pallet top resides such that multiple pallets may be stacked one upon the other by nesting a lower end of one said frame support within an upper end of an adjacent frame support positioned immediately underneath, a dividing space created between frame structures of adjacently stacked pallets being of sufficient height to accommodate the width of said detachable vertical posts as they are laid horizontally upon said pallet top, wherein said partition is specifically designed for use with knobbed glass cookware covers and further including on its top side an array of indentations, each indentation substantially corresponding to the size and shape of a lower rim of each glass cover and serving as a guide by which accurate placement of said glass cover may be achieved, within each indentation is one of said flaps which is substantially formed from a small circular cut in the center and two radial cuts extending outward therefrom, said flap including a circular tip which remains in contact with a top side of a knob projecting through said opening to prevent said knob from touching a glass cover placed immediately above it on said top side of the partition, the partition further including a plurality of radial cuts extending from said indentation to said opening to allow the portion of the partition within said indentation to conform to an upper surface of said glass cover located directly underneath.

2. The apparatus as in claim 1, wherein said partition further includes substantially square notches inwardly-formed into its corners to complimentarily engage vertical corner posts on said pallet so as to inhibit horizontal movement of said partition.

3. An apparatus for stacking and shipping such goods as knobbed glass cookware covers, the apparatus comprising:

(a) a pallet, said pallet including a frame structure having a plurality of corners within which is nested a similarly-shaped pallet top, said pallet also including vertical frame supports, each support being securely attached to one of said corners of said frame structure, said pallet further including detachable vertical posts, each post being insertable into an upper end of one said frame support;

(b) a plurality of partitions for separating layers of said type of goods stacked upon said pallet wherein each of said goods is generally flat yet has an upright projection, the partition having a size and shape approximately equal to that of said pallet and whereupon a layer of said type of goods may be placed, the partition further including a plurality of integrally-formed flaps, each flap assuming an upwardly-angled position when one of said projections from a layer of such type of goods stacked immediately underneath the partition projects upward through an opening in the partition formed by said flap, (c) a substantially rigid top plate for covering a top layer of said type of goods, the plate having a size and shape approximately equal to that of said pallet and including a plurality of equally-spaced holes to accommodate said projections from said top layer of such type of goods when said goods are stacked on a partition there beneath, said top plate further including substantially square notches inwardly-formed into its corners to complimentarily engage vertical corner posts on said pallet so as to inhibit horizontal movement of said top plate; and (d) a plurality of wrapping straps, said straps encircling said pallet, said partitions, said layers of goods when present and said top plate and positioned between adjacent projections accommodated within said holes of said top plate.

4. The apparatus as in claim 3, wherein said detachable vertical posts have a height which is approximately equal to a horizontal width of said frame structure and may be laid upon said pallet top for storage purposes.

5. The apparatus as in claim 4, wherein said frame supports extend a vertical distance upward above the plane in which said pallet top resides such that multiple pallets may be stacked one upon the other by nesting an upper end of one said frame support within a lower end of an adjacent frame support positioned immediately underneath, a dividing space created between frame structures of adjacently stacked pallets being of sufficient height to accommodate the width of said detachable vertical posts as they are laid horizontally upon said pallet top.

6. The apparatus as in claim 5, wherein said partition is capable of being used for housing knobbed glass cookware covers and, said partition further including on its top side an array of indentations, each indentation substantially corresponding to the size and shape of a lower rim of each glass cover and serving as a guide by which accurate placement of said glass cover may be achieved, within each indentation is one of said flaps which is substantially formed from a small circular cut in the center and two radial cuts extending outward therefrom, said flap including a circular tip which remains in contact with a top side of a knob projecting through said opening to prevent said knob from touching a glass cover placed immediately above it on said top side of the partition, the partition further including a plurality of radial cuts extending from said indentation to said opening to allow the portion of the partition within said indentation to conform to an upper surface of said glass cover located directly underneath.

7. The apparatus as in claim 6, wherein said partition further includes substantially square notches inwardly-formed into its corners to complimentarily engage vertical corner posts on said pallet so as to inhibit horizontal movement of said partition.

8. A system for stacking and shipping such goods as knobbed glass cookware covers, the system comprising:

(a) a stacking station at a loading facility including a first and second pallet, said first pallet having detachable vertical posts on its corners and having nothing stacked thereon, said second pallet also having detachable vertical posts on its corners and having a plurality of partitions stacked thereon, said partitions including a plurality of retaining means to accommodate knobs on cookware covers from underneath said partitions and including substantially square notches inwardly-formed into their corners to complimentarily engage said vertical posts, said partitions having a size and shape approximately equal to that of said pallet and whereupon a layer of goods may be placed, the partition further including a plurality of integrally-formed flaps, each flap assuming an upwardly-angled position as one of said projections from a layer of goods stacked immediately underneath the partition projects upward through an opening in the partition formed by said flap, said partition further including on its top side an array of indentations, each indentation substantially corresponding to the size and shape of a lower rim of each glass cover and serving as a guide by which accurate placement of said glass cover may be achieved, within each indentation is one of said flaps which is substantially formed from a small circular cut in the center and two radial cuts extending outward therefrom, said flap including a circular tip which remains in contact with a top side of a knob projecting through said opening to prevent said knob from touching a glass cover placed immediately above it on said top side of the partition, the partition further including a plurality of radial cuts extending from said indentation to said opening to allow the portion of the partition within said indentation to conform to an upper surface of said glass cover located directly underneath;

(b) means for stacking multiple layers of said glass covers upon said first pallet wherein said layers are divided by said partitions taken from said second pallet and said knobs are received by said retaining means;

(c) means for vertically stacking said pallet assemblies one upon another;

(d) means for securing said multiple layers of glass covers to said first pallet as a pallet assembly;

(e) means for vertically stacking said pallet assemblies one upon another;

(f) means for loading said pallet assemblies onto a means for transportation;

(g) means for transporting said pallet assemblies to a location for unloading;

(h) means for unloading said pallet assemblies from said means for transportation;

(i) means for unstacking said pallet assemblies from upon one another;

(j) an unstacking station including said first pallet and a third pallet, said third pallet having detachable vertical posts on its corners and having nothing stacked thereon;

(k) means for unstacking said multiple layers of glass covers upon said first pallet whereafter said partitions are stacked upon said third pallet;

(l) means for removing said vertical posts from said first pallet and laying them horizontally upon a top of said first pallet;

(m) means for stacking said first pallet upon another pallet having its vertical posts removed;

(n) means for stacking said third pallet upon another pallet upon which multiple partitions are stacked;

(o) means for loading said pallets onto a means for transportation; and (p) means for transporting said pallets back to said loading facility.

9. A method of stacking and shipping such goods as knobbed glass cookware covers, the method comprising the steps of:

(a) arranging a first and second pallet at a stacking station of a loading facility, said first pallet having detachable vertical posts on its corners and having nothing stacked thereon, said second pallet also having detachable vertical posts on its corners and having a plurality of partitions stacked thereon, said partitions including a plurality of equally-spaced retaining means to accommodate knobs on cookware covers from underneath said partitions and including substantially square notches inwardly formed into their four corners to complimentarily engage said vertical posts, said partitions having a size and shape approximately equal to that of said pallet and whereupon a layer of goods may be placed, the partition further including a plurality of integrally-formed flaps, each flap assuming an upwardly-angled position as one of said projections from a layer of goods stacked immediately underneath the partition projects upward through an opening in the partition formed by said flap, said partition further including on its top side an array of indentations, each indentation substantially corresponding to the size and shape of a lower rim of each glass cover and serving as a guide by which accurate placement of said glass cover may be achieved, within each indentation is one of said flaps which is substantially formed from a small circular cut in the center and two radial cuts extending outward therefrom, said flap including a circular tip which remains in contact with a top side of a knob projecting through said opening to prevent said knob from touching a glass cover placed immediately above it on said top side of the partition, the partition further including a plurality of radial cuts extending from said indentation to said opening to allow the portion of the partition within said indentation to conform to an upper surface of said glass cover located directly underneath;

(b) stacking multiple layers of said glass covers upon said first pallet wherein said layers are divided by said partitions taken from said second pallet and said knobs are received by said retaining means;

(c) covering a top layer of said glass covers with a rigid top plate;

(d) securing said multiple layers of glass covers to said first pallet as a pallet assembly;

(e) stacking said pallet assemblies vertically upon one another;

(f) loading said pallet assemblies onto a means for transportation;

(g) transporting said pallet assemblies to a location for unloading;

(h) unloading said pallet assemblies from said means for transportation;

(i) unstacking said pallet assemblies from upon one another;

(j) arranging said first pallet and a third pallet at an unstacking station, said third pallet having detachable vertical posts on its corners and having nothing stacked thereon;

(k) unstacking said multiple layers of glass covers upon said first pallet whereafter said partitions are stacked upon said third pallet;

(l) removing said vertical posts from said first pallet and laying them horizontally upon a top of said first pallet;

(m) stacking said first pallet upon another pallet having its vertical posts removed;

(n) stacking said third pallet upon another pallet upon which multiple partitions are stacked;

(o) loading said pallets onto a means for transportation; and (p) transporting said pallets back to said loading facility.

10. A partition for separating layers of knobbed glass cookware covers stacked upon a pallet wherein each of said goods is generally flat yet has an upright projection, the partition having a size and shape approximately equal to that of said pallet and whereupon a layer of goods may be placed, the partition further including a plurality of integrally-formed flaps, each flap assuming an upwardly-angled position as one of said projections from a layer of goods stacked immediately underneath the partition projects upward through an opening in the partition formed by said flap, said partition further including on its top side an array of indentations, each indentation substantially corresponding to the size and shape of a lower rim of each glass cover and serving as a guide by which accurate placement of said glass cover may be achieved, within each indentation is one of said flaps which is substantially formed from a small circular cut in the center and two radial cuts extending outward therefrom, said flap including a circular tip which remains in contact with a top side of a knob projecting through said opening to prevent said knob from touching a glass cover placed immediately above it on said top side of the partition, the partition further including a plurality of radial cuts extending from said indentation to said opening to allow the portion of the partition within said indentation to conform to an upper surface of said glass cover located directly underneath.

11. The partition as in claim 10, wherein the partition further includes substantially square notches inwardly-formed into its corners to complimentarily engage vertical corner posts on said pallet so as to inhibit horizontal movement of the partition.

12. An apparatus for stacking knobbed glass cookware covers, the apparatus comprising:

(a) a pallet, said pallet including a frame structure having a plurality of corners within which is nested a similarly-shaped pallet top, said pallet also including vertical frame supports, each support being securely attached to one of said corners of said frame structure, said pallet further including detachable vertical posts, each post being insertable into an upper end of one said frame support;

(b) a plurality of partitions capable of separating layers of generally flat goods having an upright projection, the partition having a size and shape approximately equal to that of said pallet and whereupon a layer of goods may be placed, the partition further including a plurality of integrally-formed flaps, each flap being capable of assuming an upwardly-angled position, said detachable vertical posts having a height which is approximately equal to a horizontal width of said frame structure and may be laid upon said pallet top for storage purposes, said frame supports extending a vertical distance upward above the plane in which said pallet top resides such that multiple pallets may be stacked one upon the other by nesting an upper end of one said frame supports within a lower end of an adjacent frame support positioned immediately underneath, a dividing space created between frame structures of adjacently stacked pallets being of sufficient height to accommodate the width of said detachable vertical posts as they are laid horizontally upon said pallet top, said partition further including on its top side an array of indentations, within each indentation is one of said flaps which is substantially formed from a small circular cut in the center and two radial cuts extending outward therefrom, said flap including a circular tip which is adapted to remain in contact with said goods projecting through said opening, the partition further including a plurality of radial cuts extending from said indentation to said opening to allow the portion of the partition within said indentation to conform to the shape of said goods located directly underneath.

13. The apparatus as in claim 12, wherein said partition further includes substantially square notches inwardly-formed into its corners to complimentarily engage vertical corner posts on said pallet so as to inhibit horizontal movement of said partition.

* * * * *